US006125792A

United States Patent [19]

Gee

[11] Patent Number: 6,125,792

[45] Date of Patent: Oct. 3, 2000

[54] SHOULDER HARNESS WITH SUPPORT HANDLE

[76] Inventor: Norman Gee, 17092 - 98th Street, Edmonton, Alberta, Canada, T5X 3G6

[21] Appl. No.: 09/193,864

[22] Filed: Nov. 18, 1998

[30] Foreign Application Priority Data

Oct. 22, 1998 [CA] Canada ..... 2251435

[51] Int. Cl.[7] ..... A62B 35/00

[52] U.S. Cl. ..... 119/770; 119/857; 119/907; 2/311; 482/69; 182/3

[58] Field of Search ..... 119/770, 857, 119/907; 434/253, 254, 255; 482/55, 69; 2/311; 182/3, 4

[56] References Cited

U.S. PATENT DOCUMENTS

| | | | |
|---|---|---|---|
| 1,193,374 | 8/1916 | Gilliam | 482/69 |
| 1,711,864 | 5/1929 | Whidden | 119/770 |
| 3,004,519 | 10/1961 | Weissman | 119/857 |
| 3,869,021 | 3/1975 | Sutherland et al. | 182/3 |
| 4,537,154 | 8/1985 | Kay | 119/96 |
| 4,553,633 | 11/1985 | Armstrong et al. | 182/3 |
| 4,892,063 | 1/1990 | Garrigan | 119/795 |
| 4,922,860 | 5/1990 | Hutchings | 119/96 |
| 5,074,795 | 12/1991 | Clark | 434/253 |
| 5,080,191 | 1/1992 | Sanchez | 182/3 |
| 5,289,896 | 3/1994 | Giglio | 182/3 |
| 5,388,551 | 2/1995 | Martusciello | 119/770 |
| 5,435,272 | 7/1995 | Epstein | 119/770 |
| 5,476,070 | 12/1995 | Gwon et al. | 119/770 |
| 5,485,810 | 1/1996 | Sporn | 119/792 |
| 5,540,188 | 7/1996 | Heinrichs | 119/770 |
| 5,619,955 | 4/1997 | Nelson | 119/857 |
| 5,634,439 | 6/1997 | O'Brien | 119/770 |
| 5,738,046 | 4/1998 | Williams et al. | 119/770 |

*Primary Examiner*—Michael J. Carone
*Assistant Examiner*—James S. Bergin
*Attorney, Agent, or Firm*—Christensen O'Connor Johnson & Kindness PLLC

[57] ABSTRACT

A support harness for a child to be used when learning activities such as skating, in-line skating, and bicycling. The support harness comprises a length adjustable chest strap having a releasable fastener, a left and right length adjustable shoulder strap, each of the shoulder straps being connected by slidable loops to the length adjustable chest strap at anterior and posterior chest strap regions; and a length adjustable handle strap with a grasping region. The handle strap is connected to the left and right shoulder straps at left and right posterior shoulder strap positions. The design and the materials used in its construction allows this support harness to be manufactured at minimal cost. It has been found that the points of support, near the shoulders and approximately aligned to the back of the neck region of the child allow the child to maintain an appropriate posture for skating and bicycling.

8 Claims, 3 Drawing Sheets

SHOULDER HARNESS WITH SUPPORT HANDLE

FIELD OF THE INVENTION

This invention relates to a child-support harness for use as an aid when learning activities such as walking, bicycling, in-line skating and skiing.

BACKGROUND OF THE INVENTION

When a child is first learning a new physical activity, it is often necessary for an adult to provide support until the child develops a sense of balance in performing the new activity. Support harnesses for the purpose of supporting children are known. Various designs are disclosed in U.S. Pat. Nos. 4,537,154 (Kay); U.S. Pat. No. 4,922,860 (Hutchings); U.S. Pat. No. 5,074,795 (Clark); U.S. Pat. No. 5,435,272 (Epstein); U.S. Pat. No. 5,540,188 (Heinrichs); U.S. Pat. No. 5,634,439 (O'Brien).

In Kay '154 a harness design suitable for a pet such as a dog or cat is disclosed. This design, said to be adaptable to children, provides a handle running along the spine of the wearer, extending approximately between the shoulder blades down to the lower back. Kay '154 is not suitable for providing support in certain types of activities since grasping the handle would tend to cause the child to lean too far forward.

Hutchings '860 provides a body harness comprising an adjustable chest band and two adjustable straps running from either shoulder, under the crotch area, and then back up to the shoulder of the wearer. The two straps continue to extend from the shoulders and form loops at their ends to provide handles for the adult providing support for the child. This design may cause undue pressure in the crotch area. A similar design is proposed in Epstein '272 wherein the harness comprises two loops which are worn between the legs and loop over either shoulder. These loops are joined at the back such that the loops resemble a "FIG. 8". An optional waist belt can be provided to secure the two loops in place. A handle is connected to the top of each loop at the shoulder region. Again, this design may cause undue pressure in the crotch area.

Heinrichs '188 provides a simple design comprising two loops connected at a grasping region. The two loops are of approximately equal size and when worn as intended, with one loop going under the arms and across the front of the chest and the other loop going under the arms and across the back and the grasping region being directly over the head of the child, the loops will tend to constrict movement of the child's head, and may also impair the child's peripheral vision.

Finally, in O'Brien '439, a belt design is disclosed where the belt is worn around the mid-section of the child and secured at the front of the chest and two loops are formed at the back of the belt to provide a handle for the adult providing support to the child. This design suffers from the same drawback as noted in Kay '154, i.e. grasping the handle at this location will cause the child to tend to lean too far forward for certain types of activities.

SUMMARY OF THE INVENTION

The support harness of the present invention is used to keep children from falling while learning such activities as ice-skating, in-line skating and bicycling. Infants can also use the harness when they are learning how to walk. The support harness may also be used to provide support for children recovering from an injury or for older children who require assistance in walking. Basically, the harness can be used for any type of activity in which there is a need to prevent falling.

In a first aspect, the present invention provides a support harness for a child, the support harness comprising: a length adjustable chest strap having at least one releasable fastening device, the chest strap forming a flexible ring when fastened around the chest and back of a child; left and right length adjustable shoulder straps, each of the shoulder straps being connected by slidable loops to the length adjustable chest strap at anterior and posterior chest strap regions; a length adjustable handle strap with a grasping region, the handle strap being connected to the left and right shoulder straps at left and right posterior shoulder strap positions, the left and right posterior shoulder strap positions being in close proximity to the slidable loops connected to the chest strap at the posterior chest strap regions.

In a second aspect, the present invention provides an apparatus, as described above, further comprising a first padded sleeve covering substantially the front and side portions of the chest strap so as to provide padding for the chest area and the armpit regions of the child when the child is being supported by the support harness, the first padded sleeve passing through the slidable loops of the left and right adjustable shoulder straps at the anterior chest strap positions.

In a third aspect, the present invention provides an apparatus as described above wherein the left and right length adjustable shoulder straps each include at least one releasable fastener.

In a fourth aspect, the present invention provides an apparatus as described above wherein the handle strap includes at least one releasable fastener.

In a fifth aspect, the present invention provides an apparatus as described above further comprising a second padded sleeve covering substantially the grasping region of the handle strap.

It is an object of this invention to provide a support harness for a child which is intended to overcome the drawbacks identified in the prior art.

Another object of this invention is to provide a support harness which can be manufactured at low cost using readily available parts and materials, and yet is fashionable to wear.

A further object of this invention is to provide a support harness for a child which is adjustable to fit different sizes of children, and one child as the child grows in size.

BRIEF DESCRIPTION OF THE DRAWINGS

The preferred embodiments of the support harness of this invention is illustrated in the accompanying drawings wherein.

DETAILED DESCRIPTION OF THE INVENTION

Figure 1:
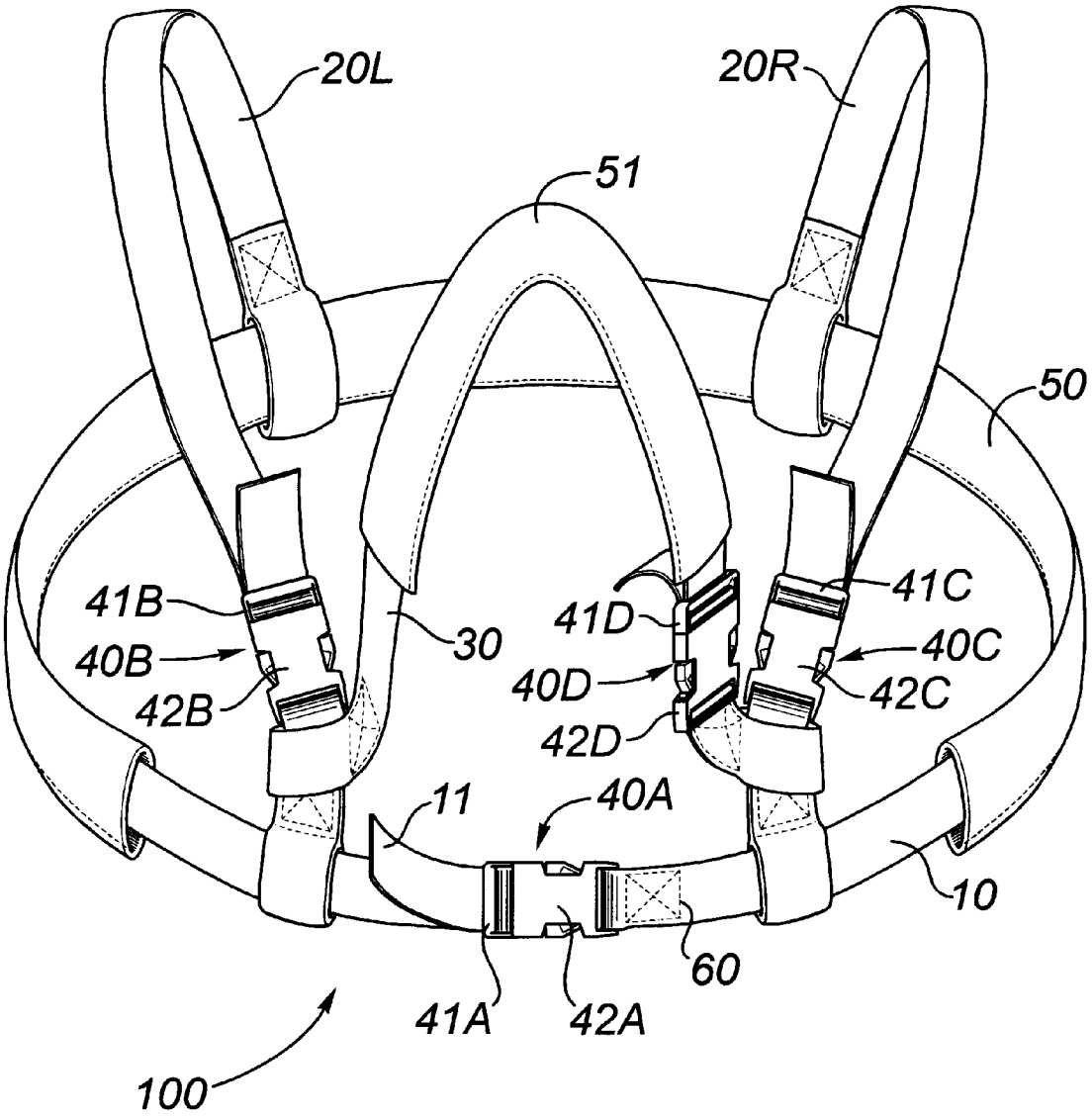
FIG. 1 shows a rear perspective view of the support harness.
Figure 2:
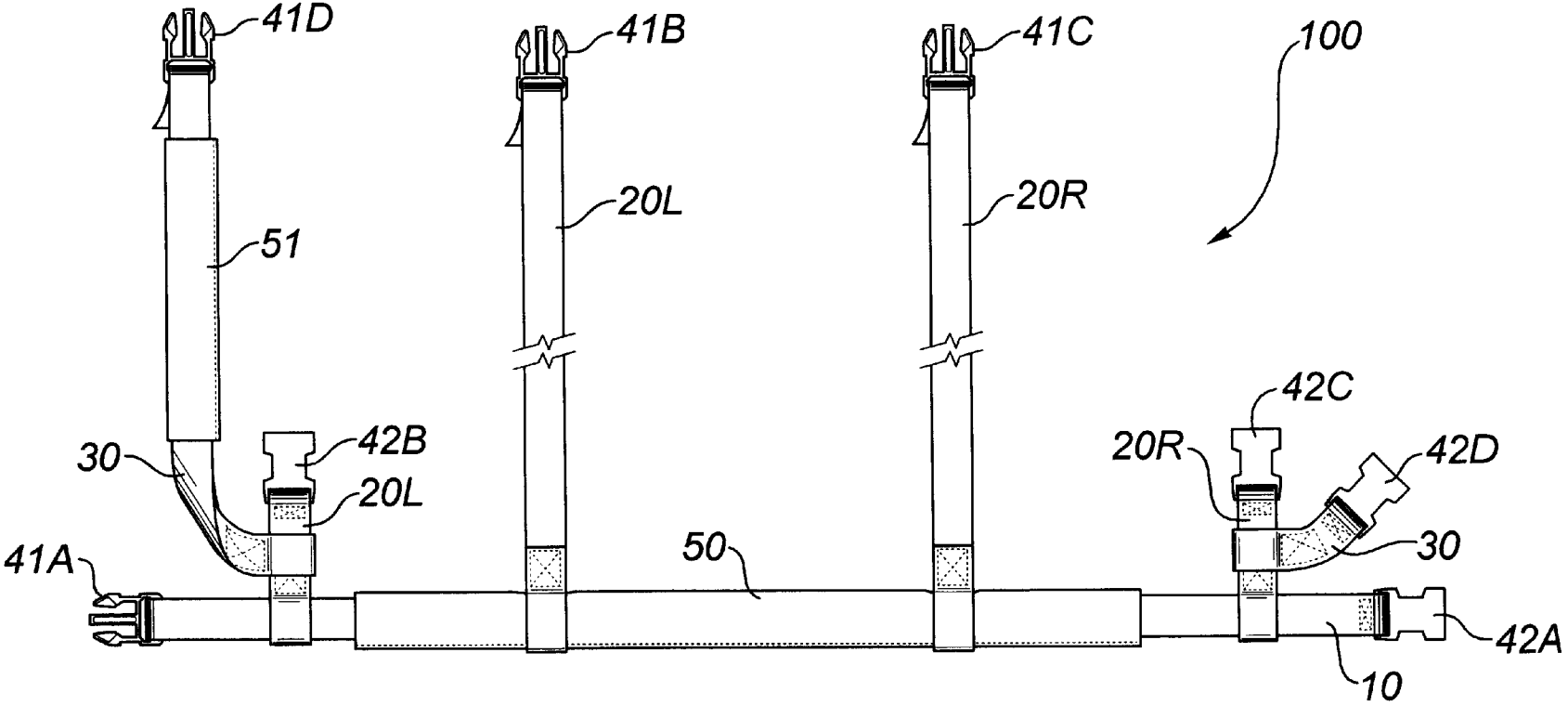
FIG. 2 is a view of the various components of the support harness when unfastened and laid out on a flat surface.

In FIGS. 1 and 2, a support harness is shown and generally referred to by reference numeral 100. A length adjustable chest strap 10 is shown with a receptacle member 42*a* fastened to a first end of the length adjustable chest strap 10. A short length of a second end of the length adjustable chest strap 10 is shown looped through a clasp member 41*a*. Together, clasp member 41*a* and receptacle member 42*a* form a releasable fastener 40*a*. Such a releasable fastener 40*a*, sometimes referred to as a quick-release plastic buckle, is described in U.S. Pat. No. 4,150,464, and U.S. Pat. No. 4,171,555. Various other releasable fastening means may also be used. When clasp member 41*a* is inserted into receptacle member 42*a*, the length adjustable chest strap 10 forms a flexible ring. The overall length of the flexible ring may be adjusted by varying the length of the second end of the chest strap 10 which is pulled through the clasp member 41*a*.

Still referring to FIGS. 1 and 2, the chest strap 10 is shown with first padded sleeve 50 covering substantially the front and side portions of the chest strap 10 so as to provide padding for the chest area and the armpit regions of the child. The first padded sleeve 50 may include a foam backing to provide additional comfort for a child wearing the support harness.

FIGS. 1 and 2 also show left and right length adjustable shoulder straps 20L, 20R. Each of the shoulder straps 20L, 20R is connected to the flexible ring formed by the fastened chest strap 10 at anterior and posterior chest strap regions. Loops are formed at both ends of each of the left and right shoulder straps 20L, 20R such that the ends of the shoulder straps 20L, 20R can slide over a limited region of the flexible ring formed by the chest strap 10. Advantageously, the ability of the ends of the shoulder straps 20L, 20R to slide along the chest strap 10 will provide a comfortable fit for a child wearing the support harness. While the looped ends of shoulder straps 20L, 20R can slide along the chest strap 10 during adjustment of the support harness 100, once the chest strap 10 is tightened and the support harness 100 is in use, frictional forces will prevent further sliding of the looped ends of shoulder straps 20L, 20R at the anterior and posterior chest strap regions until the chest strap 10 is loosened again. Preferably, the left and right shoulder straps 20L, 20R include releasable fasteners. As shown in FIG. 1 the left shoulder strap 20L is divided into two segments which are fastened together by inserting clasp member 41*b* into receptacle member 42*b*. The clasp member 41*b* and receptacle member 42*b* together form a releasable fastener 40*b* which is substantially the same as releasable fasterner 40*a*. Similarly, the right shoulder strap 20R is divided into two segments which may be fastened together by inserting clasp member 41*c* into receptacle member 42*c*. The clasp member 41*c* and receptacle member 42*c* together form a releasable fastener 40*c* which is substantially the same as releasable fastener 40*a*. The overall length of the left shoulder strap 20L may be adjusted by varying the length of the left shoulder strap 20L which is drawn through clasp member 41*b*. Similarly, the overall length of the right shoulder strap 20R may be adjusted by varying the length of the right shoulder strap 20R which is drawn through clasp member 41*c*.

Also shown in FIG. 1 is a length adjustable handle strap 30 with a grasping region. A first end of the handle strap 30 is connected to the left shoulder strap 20L in close proximity to the slidable loop connecting the left shoulder strap 20L to the chest strap 10 in the posterior chest strap region. A second end of the handle strap 30 is connected to the right shoulder strap 20R, in close proximity to the slidable loop connecting the right shoulder strap 20R to the chest strap 10 in the posterior chest strap region. As shown in FIG. 1, the first and second ends of handle strap 30 are loops which may slide. However, the movement of the first and second ends of handle strap 30 is restricted by receptacle members 42*b*, 42*c*, which are positioned in close proximity, preferably within about 4 inches or less, to the slidable loops connecting the left and right shoulder straps 20L, 20R to the posterior chest strap region.

Also shown in FIG. 1 is a second padded sleeve 51 which covers substantially the grasping region of the handle strap 30. The second padded sleeve 51 is designed to provide padding for the hand of a person supporting the child and may also include a foam backing to provide additional comfort for the person supporting the child. In addition, handle strap 30 preferably includes a releasable fastener 40*d* comprising clasp member 41*d*, and receptacle member 42*d*. The overall length of the handle strap 30 may be adjusted by varying the length of the handle strap 30 which is drawn through clasp member 41*d*.

The fact that the chest strap 10, the left and right shoulder straps 20L, 20R, and the handle strap 30 are all length adjustable means that the support harness can be adjusted to fit children of various sizes. It also allows the same support harness to be used on a child as he or she grows in size. By adjusting the chest strap 10 in cooperation with left and right shoulder straps 20L, 20R, a secure, comfortable fit can be provided and the handle strap 30 can be adjusted to a comfortable position for the adult providing support.

Figure 3:
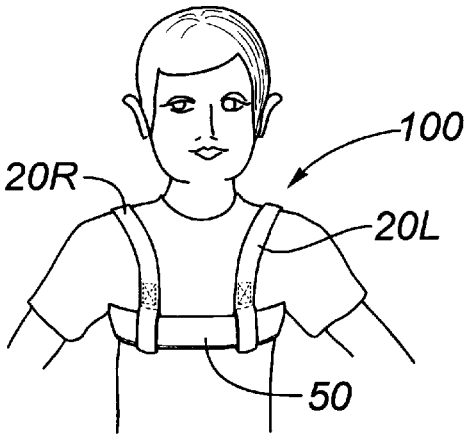
FIG. 3 is a front view of the support harness on a child.
Figure 4:
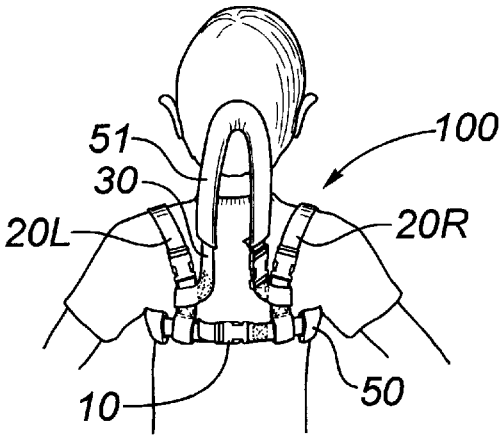
FIG. 4 is a rear view of the support harness on a child.
Figure 5:
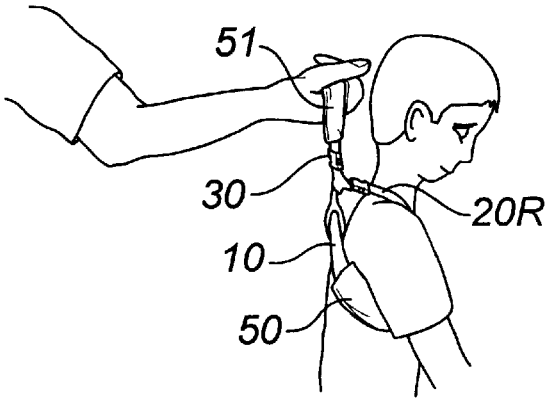
FIG. 5 is a side view of the support harness on a child with an adult holding the handle.

Now referring to FIG. 3, a front view of a child wearing the support harness 100 is shown. FIG. 4, shows a corresponding rear view of the support harness 100 worn by a child. Finally, FIG. 5 shows a side view of the support harness 100 worn by a child, and an arm of a person vertically supporting the child by grasping the second padded sleeve 51 which covers the grasping region of handle strap 30. As shown in FIG. 5, when the handle strap 30 is pulled up vertically, the back of the chest strap 10 is also pulled up such that the back of the ring formed by the chest strap 10 is higher than the front of the chest strap 10. The first padded sleeve 50 provides padding for the chest area of the child and the armpit regions of the child as shown in FIG. 5. Since the ends of the handle strap 30 are connected to left and right shoulder straps 20L, 20R, the shoulder straps are similarly drawn higher by pulling up on the handle strap 30. Advantageously, by pulling up on the support harness near the child's shoulders and approximately aligned with the back of the neck of the child, the child's sense of balance is not thrown off as may be the case when using some harness designs found in the prior art. In activities such as bicycling, ice-skating, in-line skating, and skiing, it has been found that supporting the harness at this location provides the child with good balance and promotes a proper posture. In addition, the handle does not impede movement of the child's head and does not obstruct the child's view. Furthermore, by adjusting the length of the handle strap 30 a comfortable arm position can be found for the person providing support to the child. Also, providing one handle which is connected to both shoulder straps allows the person to use either a one-handed or two-handed grip to support the child. One-handed operation may be preferable for such activities as bicycling where the person providing support must stand to one side of the child. Two-handed operation may be preferable in such activities as ice-skating or skiing where the person providing support is typically standing behind the child.

In order to manufacture the support harness of the present invention at minimal cost, the support harness comprises materials and parts which are readily available off-the-shelf items. As an example, the chest strap 10, shoulder straps 20L, 20R, and handle strap 30 can be manufactured from nylon webbing strips of various widths. It has been found that a one inch width is suitable for the straps used in the present invention. However, a nylon strap of greater or lesser width may also be used. Releasable fasteners 40*a*, 40*b*, 40*c*, 40*d*, comprising clasp members 41*a*, 41*b*, 41*c*, 41*d* and receptacle members 42*a*, 42*b*, 42*c*, 42*d*, respectively, which correspond to the width of the nylon strip used, can also be purchased off-the-shelf at minimal cost. Finally the padded sleeves 50, 51 may be manufactured from any suitable material which will provide a degree of padding over the nylon straps. For example the padded sleeves 50, 51 of the present invention may be made from nylon fabric which is folded over and sewn to form sleeves which will fit over the nylon straps. Optionally, the padded sleeve 50, 51 may include a foam backing to provide additional comfort for the wearer and the person providing support. The loops formed at the ends of left and right shoulder straps 20L, 20R and handle strap 30 may be made by folding over a small segment of the ends of the straps and by fastening those ends back onto the same straps to form loop openings. Fastening means used for this purpose may include nylon thread, metal clamps or staples, buttons, etc. By using these materials and manufacturing methods, the overall manufacturing cost of the support harness of the present invention is kept to a minimum. In addition, it is expected that the use of these materials, which are presently being used for products such as back packs, will make the support harness fashionably attractive to wear.

While the invention has been described with respect to the preferred embodiment, it will be apparent to those skilled in the art that changes may be made without departing from the scope of the invention. Accordingly, it is intended that the above description be interpreted as illustrative and not limiting.

I claim:

1. A support harness for a child, said support harness, comprising:

(a) a length-adjustable chest strap having at least one releasable fastener, said chest strap forming a flexible ring when fastened around the chest and back of the child;

(b) left and right length-adjustable shoulder straps, each of said shoulder straps being connected by slidable loops to said length-adjustable chest strap at anterior and posterior chest strap regions;

(c) a length-adjustable handle strap with grasping region, said handle strap being connected to said left and right shoulder straps at left and right posterior shoulder strap positions, said left and right posterior shoulder strap positions being in close proximity to said slidable loops connected to said chest strap at said posterior chest strap regions; and (d) a first padded sleeve covering substantially the front and side portions of said chest strap so as to provide padding for the chest area and the arm-pit regions of the child when the child is being supported by said support harness, said first padded sleeve passing through the slidable loops of said left and right adjustable shoulder straps at said anterior chest strap positions.

2. The apparatus claimed in claim 1 wherein said left and right length-adjustable shoulder straps each include at least one releasable fastener.

3. The apparatus claimed in claim 1 wherein said handle strap includes at least one releasable fastener.

4. The apparatus claimed in claim 1, 2 or 3 wherein said releasable fasteners comprise quick-release plastic buckles.

5. The apparatus claimed in claim 1 further comprising a second padded sleeve covering substantially the grasping region of said handle strap.

6. The apparatus claimed in claim 5 wherein said first padded sleeve and second padded sleeve are made from folded nylon fabric.

7. The apparatus claimed in claim 1 wherein said chest strap, shoulder straps and said handle strap are made from strips of nylon webbing.

8. The apparatus claims in claim 7, wherein said slidable loops comprise loops formed by folding over and fastening the end of said strips of nylon webbing into another portion of said strips of nylon webbing, so as to form loop openings which will accommodate said first padded sleeve.

* * * * *